US006574801B1

(12) United States Patent
Harens et al.

(10) Patent No.: US 6,574,801 B1
(45) Date of Patent: Jun. 10, 2003

(54) FACE MASK

(76) Inventors: Scott Aidan Harens, 143 Mapuia Rd, Miramar, Wellington (NZ); Nicholas Noel Rowney, 28 Mills Road, Brooklyn, Wellington (NZ)

( * ) Notice: Subject to any disclaimer, the term of this patent is extended or adjusted under 35 U.S.C. 154(b) by 0 days.

(21) Appl. No.: 09/003,633

(22) Filed: Jan. 12, 1998

(51) Int. Cl.[7] ..... A42B 1/18
(52) U.S. Cl. ..... 2/206; 2/9; 128/857
(58) Field of Search ..... 2/206, 9; 128/857

(56) References Cited

U.S. PATENT DOCUMENTS

| | | | | |
|---|---|---|---|---|
| 3,594,813 A | | 7/1971 | Sanderson | 2/2 |
| 4,122,847 A | | 10/1978 | Craig | |
| 4,467,799 A | | 8/1984 | Steinberg | |
| 4,534,342 A | | 8/1985 | Paxa | 128/163 |
| 4,635,625 A | | 1/1987 | Teeple | 128/163 |
| 4,674,133 A | | 6/1987 | Oschner | 2/206 |
| 4,783,350 A | | 11/1988 | DeMatteo et al. | 428/16 |
| 4,856,535 A | | 8/1989 | Forbes | |
| 4,901,714 A | * | 2/1990 | Jensen | 128/857 |
| 4,920,580 A | | 5/1990 | Liff | 2/206 |
| 4,941,212 A | | 7/1990 | Liff | 2/206 |
| 5,072,460 A | | 12/1991 | Weder | |
| 5,592,687 A | * | 1/1997 | Lajeunesse | 2/9 |
| 5,682,607 A | | 11/1997 | Klein | 2/9 |
| 5,711,026 A | | 1/1998 | Kaltman et al. | 2/9 |
| 5,765,231 A | * | 6/1998 | Leonard et al. | 2/206 |

FOREIGN PATENT DOCUMENTS

| | | | |
|---|---|---|---|
| EP | 0 365 442 A1 | 4/1990 | B29C/51/14 |
| EP | 0 365 442 B1 | 1/1992 | B29C/51/14 |
| WO | WO 9802126 | 1/1998 | A61H/35/00 |

* cited by examiner

*Primary Examiner*—Diana Oleksa
(74) *Attorney, Agent, or Firm*—Gifford, Krass, Groh, Sprinkle, Anderson & Citkowski, P.C.

(57) ABSTRACT

A face mask comprising a forehead section (1), a cheek and nose section (2) and a chin section (3). Each section is provided with graphics material (4, 5, 6) thereon. An adhesive layer (7; 9) is applied to the underside of each mask section to enable it to be secured to the face of a user. The face mask is preferably provided upon a backing sheet (8, 10) which may be in the form of a ticket.

16 Claims, 1 Drawing Sheet

FIG - 1
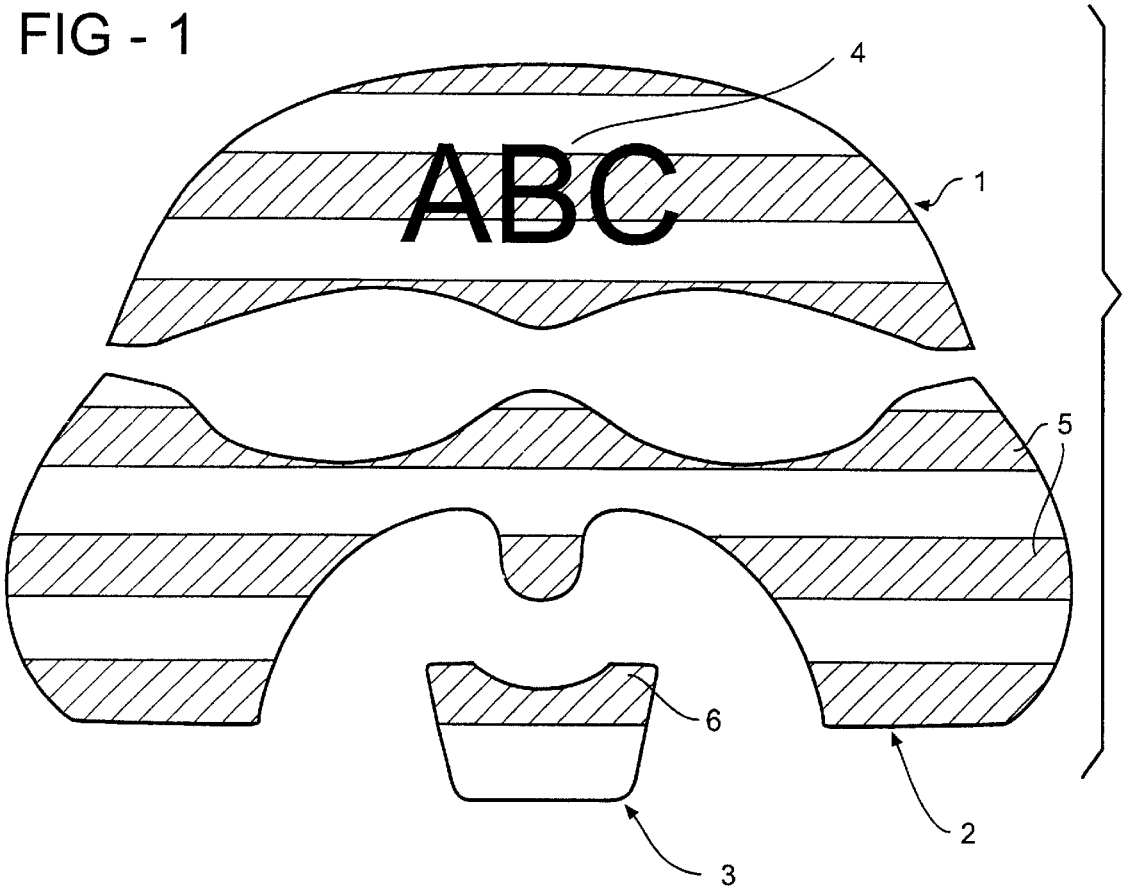
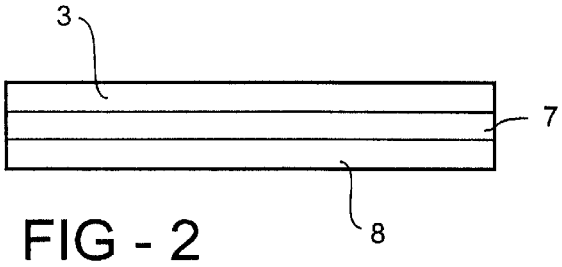
FIG - 2
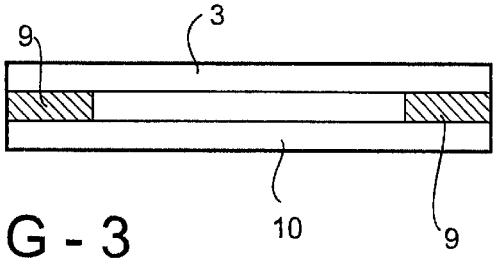
FIG - 3

FACE MASK

FIELD OF THE INVENTION

The present invention relates to a face mask. More particularly, but not exclusively, the present invention relates to a face mask which enables graphical material to be temporarily displayed on a user's face whilst being easily removed.

BACKGROUND OF THE INVENTION

At sporting fixtures and other major events spectators are increasingly applying graphics to their faces to show their support for a particular side or theme. Such graphics are typically applied by directly applying coloured compositions to a users face. Such make-up is time consuming to apply and may be difficult to remove.

SUMMARY OF THE INVENTION

It is an object of this invention to provide a face mask that may be easily applied and removed or to at least provide the public with a useful choice.

Accordingly, there is provided a face mask comprising one or more sheet of flexible material having an adhesive applied to the underside thereof being shaped and sufficiently flexible to be conformable to the face of a user when adhered thereto.

Preferably the mask covers substantially the entire face of a user and is formed in a number of sections: preferably a forehead; cheek and nose; and chin section. Graphics material may be applied to the mask during manufacture or by a user.

The mask is preferably formed of a medical tape, such as 1533 non-woven medical tape produced by 3M. Adhesive may be applied either to the entire underside of the mask or only around the periphery thereof. The adhesive is preferably an hypoallergenic pressure sensitive adhesive, such as an acrylate adhesive. The mask is preferably mounted to a removable backing strip.

There is further provided a method of decorating a face of a user comprising providing a face mask has hereinbefore described and applying the face mask to the face of a user.

The mask may be decorated by a user prior to application for be pre-decorated.

BRIEF DESCRIPTION OF THE DRAWINGS

The invention will now be described by way of example with reference to the accompanying drawings in which:

FIG. 1: shows a face mask formed in three sections.

FIG. 2: shows a cross-sectional view of a portion of the face mask according to a first embodiment.

FIG. 3: shows a cross-sectional view of the face mask according to a second embodiment.

DETAILED DESCRIPTION OF THE PREFERRED EMBODIMENTS

Referring to FIG. 1, a face mask having a forehead section 1, cheek and nose section 2 and chin section 3 is shown. The sections 1, 2 and 3 are dimensioned so as to conform to and substantially cover the faces of a wide range of the population.

The face mask sections 1, 2 and 3 are preferably formed of a sheet of medical tape. The material is preferably 1533 non-woven medical tape produced by 3M having a thickness of about 5.5 mils. This is a non-woven rayon tape that can receive printing directly on its surface.

Graphics material 4, 5, 6 may be applied to the face mask sections as desired. Such graphics may be applied during manufacture of the face mask or by a user. Such graphics may be applied by flexographic or letter press processes during manufacture or by hand or by an ink jet printer etc by a user. Where graphics are to be applied by a user the material must be adapted to receive such graphics thereon. Such graphics may consist of team colours, team logos or graphics of sponsors etc.

Referring now to FIG. 2 a first embodiment is shown in which the underside of face mask portion 3 has an adhesive 7 applied thereto. The adhesive should be such as to secure the face mask portion to the face of a user whilst being nonirritating. A preferred adhesive layer is a hypoallergenic pressure-sensitive acrylate adhesive. Face mask portion 3 and adhesive 7 are provided on a backing sheet 8. Backing sheet 8 may be a urathane backing sheet. In use, backing sheet 8 may be removed by a user to enable face mask portion 3 to be secured to the user's face. Backing sheet 8 may be a ticket for entry to an event.

Referring now to FIG. 3, face mask portion 3 is seen to be provided with adhesive 9 only around the peripheral edges thereof. This arrangement minimises the adhesive required to secure the face mask portion to a face thus increasing comfort and facilitating easy removal of the face mask portion. Again, the face mask portion 3 is provided upon a removable backing sheet 10. It will be appreciated that other adhesive patterns, such as spots of adhesive, may be used. It will be appreciated that adhesive may be applied to the other face mask portions in the same way. All of the face mask portions may be provided upon one continuous backing sheet to facilitate easy removal therefrom.

Although the preferred embodiment consists of a face mask formed in three sections it is to be appreciated that other numbers of sections may be employed. The face mask may be formed in a single piece or may be formed in any desired number of sections. It is however preferred that the mask is formed in the sections shown in FIG. 1 to ensure the mask sections best conform to a wide range of face shapes. The material from which the face mask is formed should have suitable flexibility to enable the mask to conform to the shape of a user's face.

It is thus seen that the present invention provides a face mask enabling high quality graphics to be easily secured and removed from the face of a user.

Where in the foregoing description reference has been made to integers or components having known equivalents then such equivalents are herein incorporated as if individually set forth.

Although this invention has been described by way of example it is to be appreciated that improvements and/or modifications may be made thereto without departing from the scope of the invention as defined in the appended claims.

We claim:

1. A face mask formed of at least one sheet of flexible material having an adhesive applied to an underside thereof and being shaped and sufficiently flexible to conform to the face of a user when adhered thereto, said mask comprising a plurality of sections including a first section adapted to cover the forehead of a user, a second section adapted to cover the cheeks and nose of a user, and a third section adapted to cover the chin of a user.

2. A face mask as claimed in claim 1 wherein the mask is dimensioned to substantially cover the entire face of user.

3. A face mask as claimed in claim 1 wherein pre-printed graphics are applied to the mask on a top side thereof.

4. A face mask as claimed in claim 1 wherein the mask is formed of a material adapted to receive markings applied by hand.

5. A face mask as claimed in claim 1 wherein the flexible material is a flexible, non-woven rayon tape.

6. A face mask as claimed in claim 1 wherein the flexible material is a flexible tape about 5 mils thick.

7. A face mask as claimed in claim 1 wherein the flexible material is medical tape.

8. A face mask as claimed in claim 1 wherein said adhesive is applied to the entire underside of the mask.

9. A face mask as claimed in claim 8 wherein the adhesive is a pressure sensitive adhesive.

10. A face mask as claimed in claim 8 wherein the adhesive is a hypoallergenic pressure sensitive adhesive.

11. A face mask as claimed in claim 1 wherein said adhesive is applied only to regions near edges of the mask.

12. A face mask as claimed in claim 11 wherein the adhesive is a hypoallergenic pressure sensitive acrylate adhesive.

13. A face mask comprising at least one sheet of flexible material having an adhesive applied to an underside thereof and being shaped and sufficiently flexible to conform to the face of a user when adhered thereto and a removable backing sheet formed of urethane and disposed on said adhesive.

14. A face mask as claimed in claim 13 wherein the flexible material is a flexible, non-woven rayon tape.

15. A face mask as claimed in claim 13 wherein the flexible tape is about 5 mils thick.

16. A face mask as claimed in claim 13 wherein the flexible tape is a non-woven medical tape.

* * * * *

UNITED STATES PATENT AND TRADEMARK OFFICE

CERTIFICATE OF CORRECTION

PATENT NO. : 6,574,801 B1
DATED : June 10, 2003
INVENTOR(S) : Scott Aidan Harens It is certified that error appears in the above-identified patent and that said Letters Patent is hereby corrected as shown below:

Column 4,
Line 3, replace "Claim 11" with -- Claim 8 --.

Signed and Sealed this

Twenty-seventh Day of January, 2004

JON W. DUDAS
*Acting Director of the United States Patent and Trademark Office*